US009506273B2

(12) United States Patent
Low

(10) Patent No.: US 9,506,273 B2
(45) Date of Patent: Nov. 29, 2016

(54) LOCK CYLINDER

(75) Inventor: Matthias Low, Ratingen (DE)

(73) Assignee: HUF HULSBECK & FURST GMBH & CO. KG, Velbert (DE)

( * ) Notice: Subject to any disclaimer, the term of this patent is extended or adjusted under 35 U.S.C. 154(b) by 876 days.

(21) Appl. No.: 13/505,691

(22) PCT Filed: Nov. 5, 2010

(86) PCT No.: PCT/DE2010/075123
§ 371 (c)(1),
(2), (4) Date: May 2, 2012

(87) PCT Pub. No.: WO2011/057626
PCT Pub. Date: May 19, 2011

(65) Prior Publication Data

US 2012/0216585 A1 Aug. 30, 2012

(30) Foreign Application Priority Data

Nov. 10, 2009 (DE) ..... 10 2009 052 406

(51) Int. Cl.
*E05B 17/04* (2006.01)
*E05B 27/00* (2006.01)
*E05B 17/00* (2006.01)

(52) U.S. Cl.
CPC ..... *E05B 27/0003* (2013.01); *E05B 17/04* (2013.01); *E05B 17/0058* (2013.01); *Y10T 70/7672* (2015.04); *Y10T 70/8486* (2015.04)

(58) Field of Classification Search
USPC ..... 70/237, 238, 374, 379 R, 380, 379 A, 70/461, 466
See application file for complete search history.

(56) References Cited

U.S. PATENT DOCUMENTS

| | | | | |
|---|---|---|---|---|
| 2,650,492 | A * | 9/1953 | Jacobi | 70/490 |
| 2,750,788 | A * | 6/1956 | Jacobi | 70/379 R |
| 5,050,410 | A * | 9/1991 | Claar et al. | 70/237 |
| 5,263,348 | A * | 11/1993 | Wittwer | 70/379 R |
| 6,508,088 | B1 * | 1/2003 | Barbier et al. | 70/186 |
| 6,826,934 | B2 * | 12/2004 | Canard | 70/186 |
| 6,938,446 | B2 * | 9/2005 | Fukunaga et al. | 70/237 |
| 2002/0184931 | A1 * | 12/2002 | Wittwer | 70/237 |
| 2004/0250579 | A1 * | 12/2004 | Capka et al. | 70/492 |
| 2009/0151411 | A1 * | 6/2009 | Um et al. | 70/237 |

FOREIGN PATENT DOCUMENTS

| | | |
|---|---|---|
| DE | 440 783 C | 2/1927 |
| DE | 38 27 418 A1 | 2/1990 |

(Continued)

OTHER PUBLICATIONS

International Search Report under date of Apr. 13, 2011, in connection with PCT/DE2010/075123.

*Primary Examiner* — Christopher Boswell
(74) *Attorney, Agent, or Firm* — Quarles & Brady LLP

(57) ABSTRACT

The invention relates to a lock cylinder (1), comprising a housing (2), in which a sleeve (3) having a cylinder core (4) accommodated therein is rotatably supported and the cylinder core (4) has spring-loaded tumblers (5), which form a form closure with recesses arranged in the sleeve (3) when a key is removed. Inside the housing (2), the sleeve (3) is coupled to a coupling element (7) by means of a disengaging sleeve (6), wherein the coupling element (7) is supported inside the housing (2) and the coupling element (7) is connected to a bearing (8) in a rotationally-fixed manner, wherein the bearing (8) is used to support an output (9), wherein at least one means (6, 7), which forms a form closure with the bearing (8), is provided to block the rotation of the output (9) about the axis (A) if an improper object is used in operative connection with the cylinder core (4).

11 Claims, 5 Drawing Sheets

(56) References Cited

FOREIGN PATENT DOCUMENTS

Figure 1A:
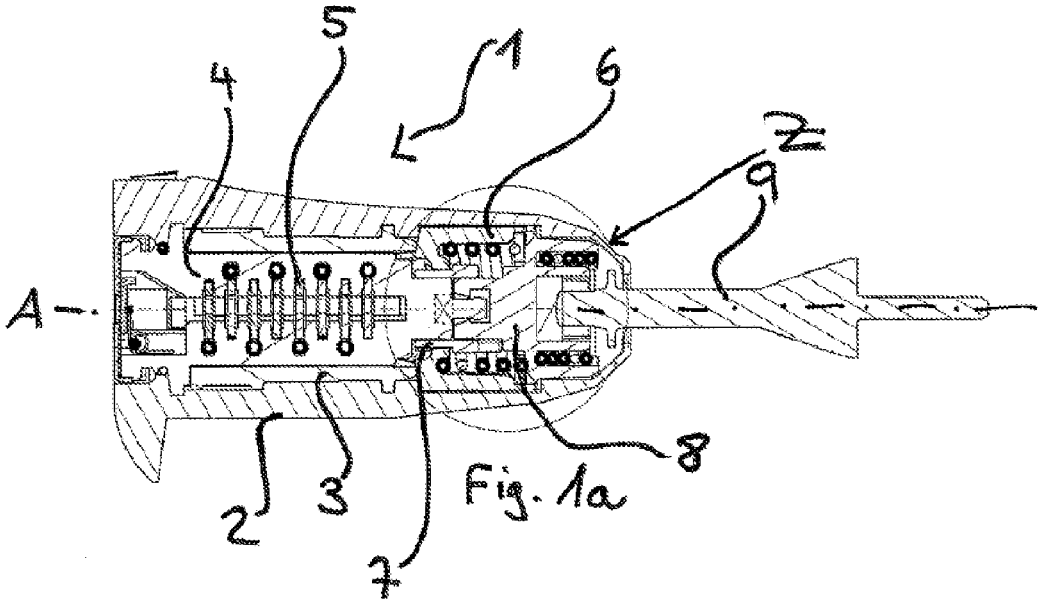

| | | | |
|---|---|---|---|
| DE | 43 16 223 | A1 | 11/1993 |
| DE | 44 08 910 | A1 | 9/1995 |
| DE | 694 17 499 | T2 | 9/1999 |
| DE | 10 2004 032157 | A1 | 1/2006 |
| EP | 0 647 752 | A1 | 4/1995 |
| EP | 0 769 597 | A1 | 4/1997 |
| EP | 0 943 758 | A1 | 9/1999 |
| FR | 2 882 772 | A1 | 9/2006 |

* cited by examiner

LOCK CYLINDER

CROSS-REFERENCE TO RELATED APPLICATIONS

This application claims priority to PCT Internationl Application No. PCT/DE2010/075123 filed on Nov. 5, 2010, which claims priority to German Patent Applicatoin No. 10 2009 052 406.1 filed on Nov. 10, 2009, both of which are fully incorporated by reference herein.

The invention relates to a lock cylinder comprising a housing, in which a sleeve having a cylinder core accommodated therein is rotatably mounted and the cylinder core has spring-loaded tumblers which form a form closure with recesses arranged in the sleeve when a key is removed, and within the housing the sleeve is coupled to a coupling element by means of a disengaging sleeve, wherein the coupling element is mounted within the housing and the coupling element is connected in a rotationally fixed manner to a bearing, which bearing serves to support an output element.

Lock cylinders having an axial freewheel are known from the prior art. In the lock cylinders disclosed by the prior art, if an improper object is used in operative connection with a lock cylinder, the lock cylinder is decoupled from the bearing. During the decoupling, a cam portion of a coupling element makes its way into a groove present on the housing, so that a rotational movement of an output element configured as an espagnolette is prevented if, for instance, a tool engages the espagnolette in order to forcibly open a lock when the espagnolette is subsequently turned by the tool. In the prior art it is disadvantageous, however, that the groove in the housing, which groove is positively connected to the cam of the disengaging sleeve, for structural reasons adjoins a central center axis of the lock cylinder. The result of this is that, with the aid of the tool which engages the espagnolette, a low force action or applied moment is sufficient to release the positive connection between groove and cam. The resistance moment acting between groove and cam is then insufficient to combat the applied moment acting on the espagnolette, so that the espagnolette can be forcibly rotated in order to open a lock without a proper key.

The object of the invention is therefore to provide a more secure lock cylinder which prevents forcible opening of a lock by way of an output element of a lock cylinder.

The invention is achieved by virtue of the fact that, if an improper object is used in operative connection with the cylinder core, at least one means is provided, which means forms a form closure with the bearing in order to block rotation of the output element about the axis A.

If the bearing is used for a form closure, it is possible to form the form closure at a greater distance from the center axis of the lock cylinder. Hence if an improper object, in particular a tool, is used in operative connection with the lock cylinder, a higher force or applied moment than in the prior art is required to make the output element rotate.

In a preferred embodiment of the invention, it is provided that the bearing has at least one recess or opening, which respectively forms the form closure with a cam portion assigned to the means.

According to another preferred embodiment, it is provided that the means form a form closure with the housing. Security can thereby be further enhanced, since the forces on the tool have to be increased in order to undo the form closure between the bearing and the means. The form closure increases the resistance moment of the output element against turning when the tool which engages the output element is used.

The design is very simple and cost-effective if the housing has at least one opening and/or recess, which serves for the form closure with the cam portion assigned to the means.

According to a preferred embodiment of the lock cylinder, the recess is configured as a groove.

The resistance moment of the output element against rotation when a tool engages the output element is increased if a contact surface of the cam portion and a contact surface of the bearing are substantially complementary to each other.

According to a preferred embodiment of the lock cylinder, it is provided that the contact surface of the cam portion and the contact surface of the bearing is respectively configured as an inclined plane.

The lock cylinder is very secure against break-in if the disengaging sleeve is provided as the means. In addition or alternatively, the coupling element is provided as the means.

According to another preferred embodiment of the lock cylinder, it is provided that the output element is configured as an espagnolette.

Figure 1B:
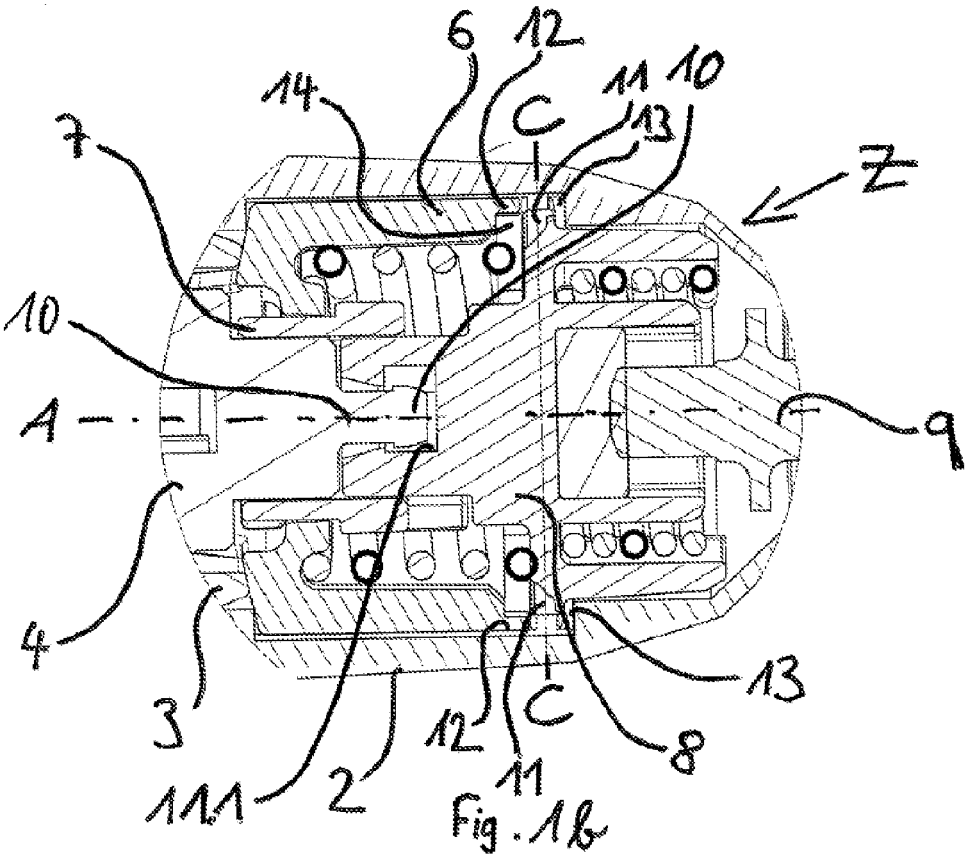
Figure 1C:
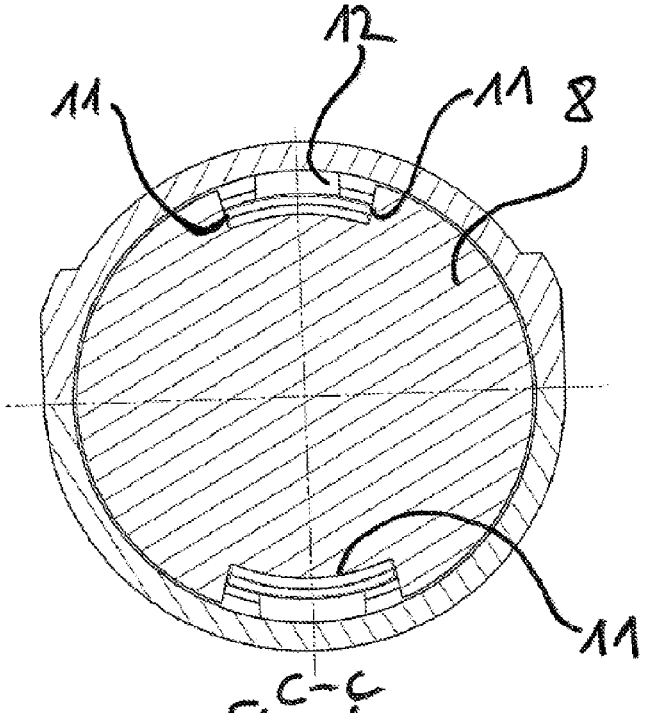
Figure 2A:
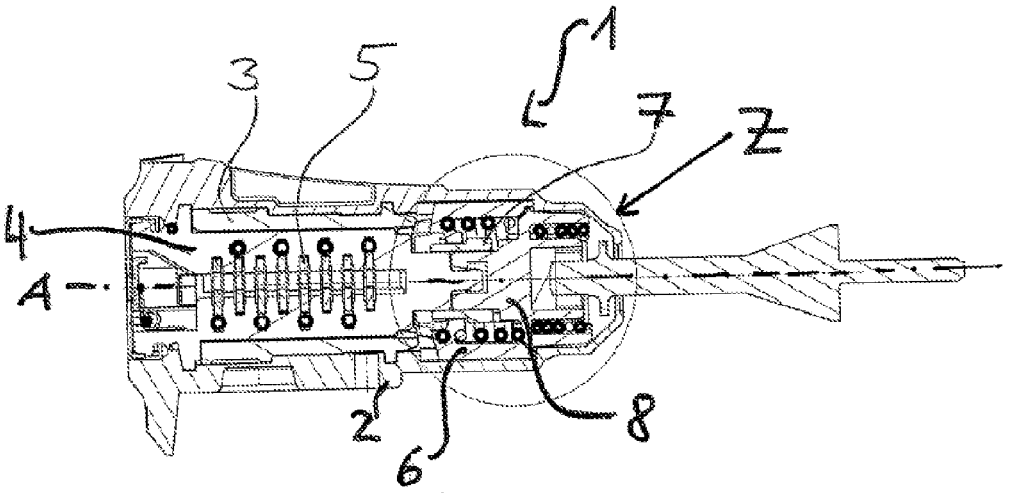
Figure 2B:
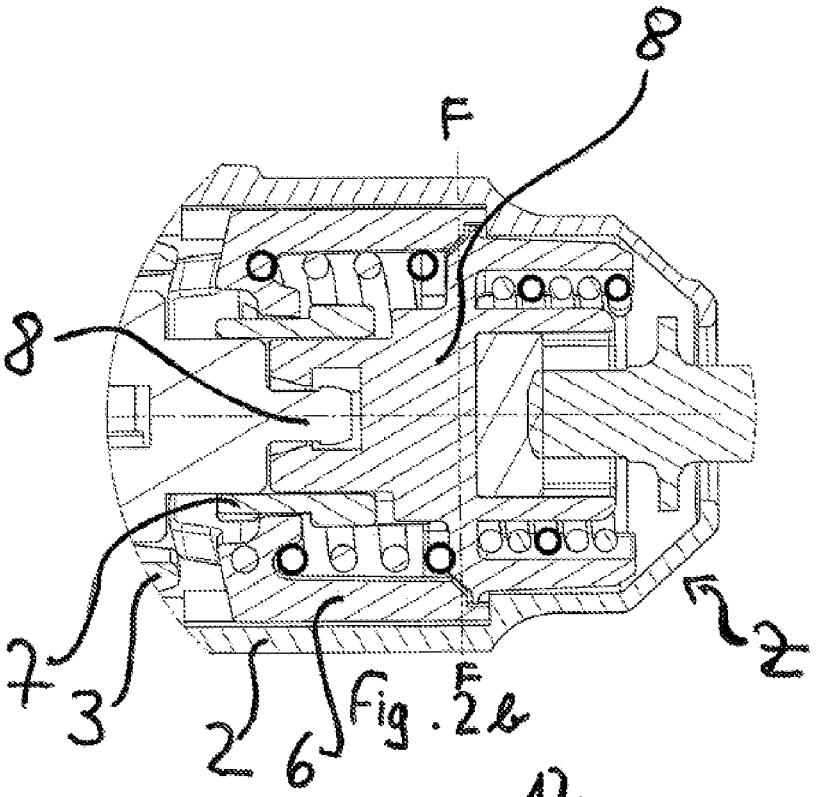
Figure 2C:
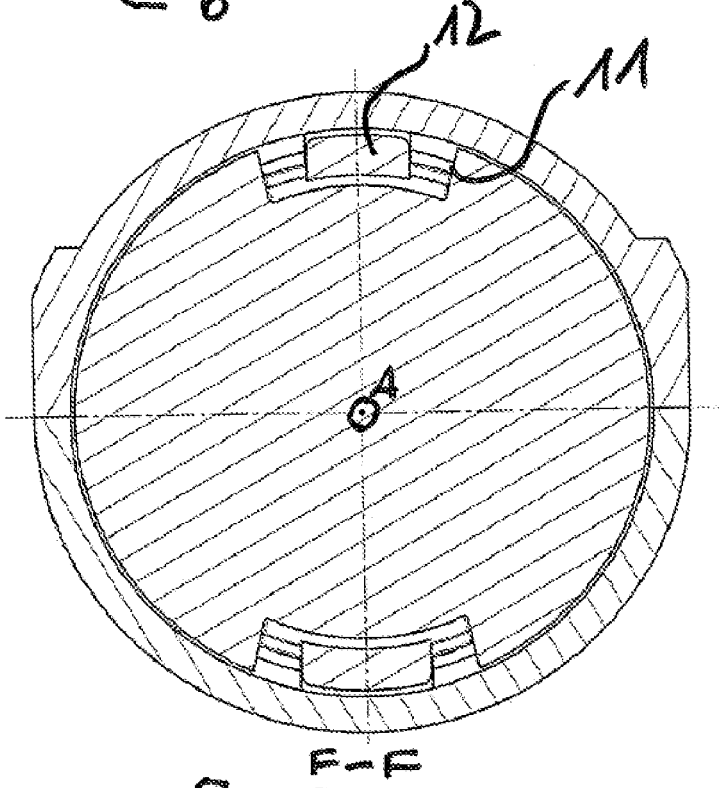
Figure 3A:
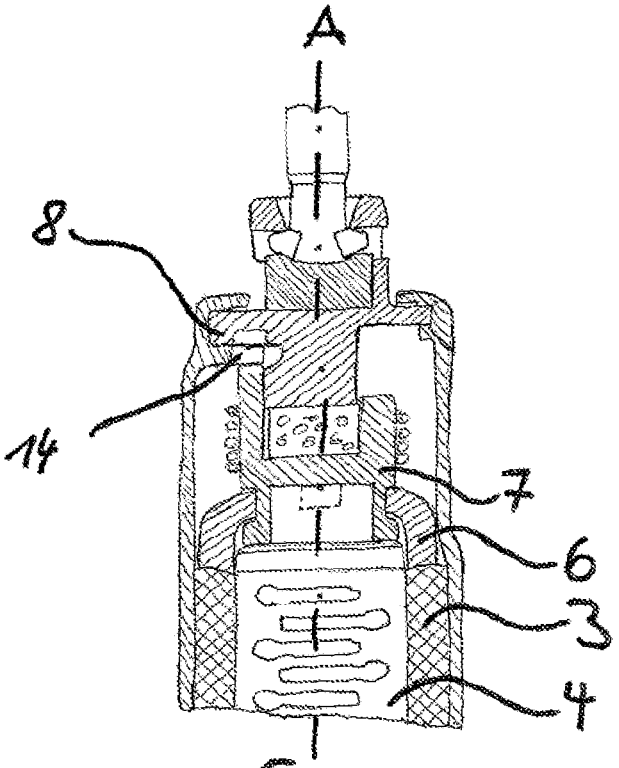
Figure 3B:
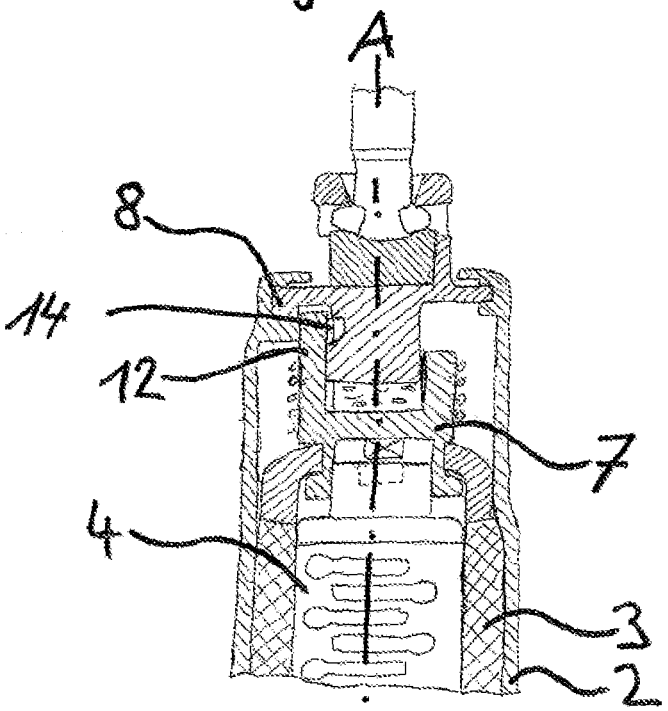
Figure 4A:
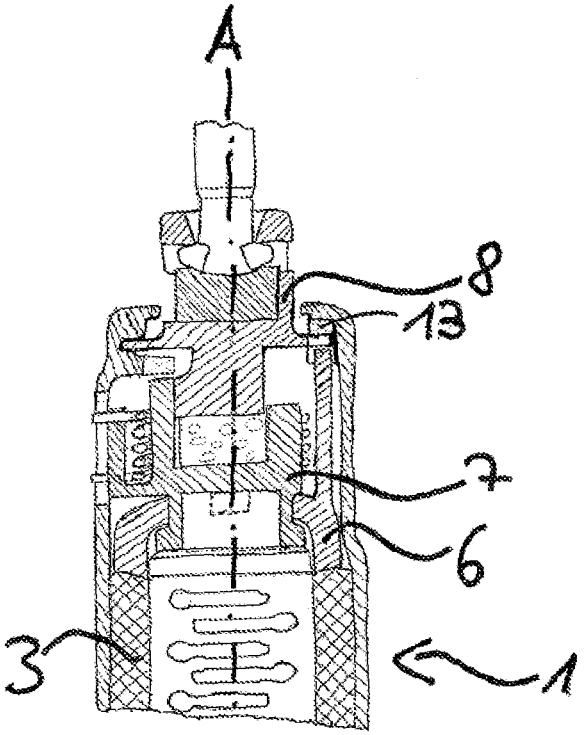
Figure 4B:
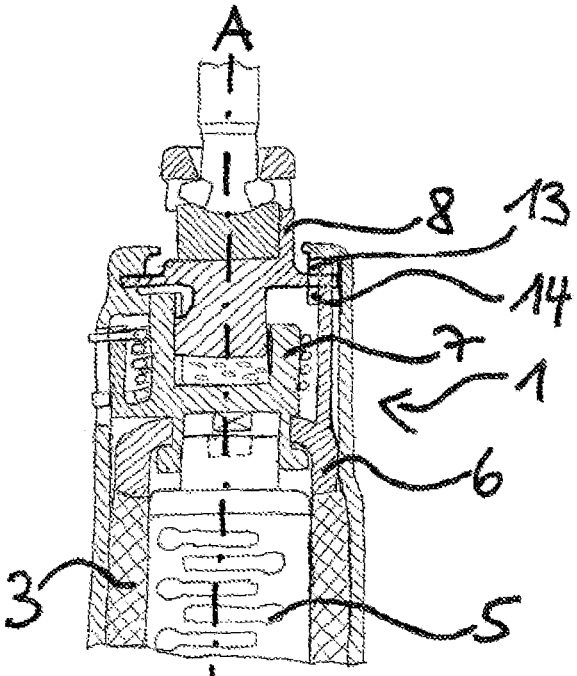

In the figures, the invention is represented schematically on the basis of two illustrative embodiments, wherein:

FIG. 1*a* shows a lock cylinder according to a first embodiment in case of a proper use, FIG. 1*b* shows an enlarged region Z of the lock cylinder according to the first embodiment, FIG. 1*c* shows the lock cylinder according to the first embodiment sectioned through the axis C-C in FIG. 1*b*, FIG. 2*a* shows the lock cylinder according to the first embodiment in case of an improper use, FIG. 2*b* shows the enlarged region Z of the lock cylinder according to the first embodiment, FIG. 2*c* shows the lock cylinder according to the first embodiment sectioned through the axis F-F in FIG. 2*b*, FIG. 3*a* shows the lock cylinder according to a second embodiment in case of a proper use, FIG. 3*b* shows the lock cylinder according to the second embodiment in case of an improper use, FIG. 4*a* shows the lock cylinder according to a third embodiment in case of a proper use, FIG. 4*b* shows the lock cylinder according to the third embodiment in case of an improper use, A lock cylinder 1 according to a first embodiment is represented in FIGS. 1*a* to 1*c* and 2*a* to 2*c*. In FIG. 1*a*, the lock cylinder 1 is shown in a proper use.

A proper use exists if a lock (not shown in detail) operatively connected to the lock cylinder 1 can be opened and closed with a proper key assigned to the lock cylinder 1. In FIG. 2*a*, the lock cylinder 1 according to the first embodiment is shown in an improper use. An improper use exists if the lock (not shown in detail) operatively connected to the lock cylinder 1 is attempted to be opened with a key (incorrect key) not assigned to the lock cylinder 1, or with a tool, in particular with a screwdriver. The lock cylinder 1 shown in FIGS. 1*a*, 2*a* and 1*b*, 2*b* has a housing 2, in which a metallic sleeve 3 having a cylinder core 4 accommodated therein is rotatably mounted. The cylinder core 4 has spring-loaded tumblers 5, which, when a key (not represented in detail) is removed from the cylinder core 4, form a form closure with recesses (not shown) arranged in the sleeve 3. Within the housing 2, the sleeve 3 is coupled to a coupling element 7 by means of a disengaging sleeve 6. The coupling element 7 is connected via a groove in a rotationally fixed manner to a bearing 8 for the reception of an output element 9 configured to actuate a lock. In the present embodiments, the output element 9 is configured as an espagnolette. Alternatively, the output element could also, however, consist of gearwheels which open and close a lock. The cylinder core 4 has a pin 10, which engages in a recess 11.1 assigned to the bearing 8. In addition, the bearing 8 has openings 11, which, if the improper object is used in operative connection with the closing cylinder 1, forms a form closure with the disengaging sleeve 6. As is shown in FIGS. 2*a*, 2*b* and 2*c*, cam portions 12 of the disengaging sleeve 6 here form a form closure with the openings 11 arranged on the bearing 8. In addition, recesses 13 and further openings 14, which likewise serve to receive the cam portions 12 of the disengaging sleeve 6, are arranged in the housing 2 of the lock cylinder 1. These measures bring about a further increase in the resistance moment by shearing of the cam portion 12 on the recess 13 and of the opening 14 in the housing 2, which resistance moment combats the torque which is generated due to a forcible rotation by a tool that engages the output element. As represented in FIG. 1*b*, the contact surfaces of the respective cam portions 12 and the respective contact surfaces of the bearing 8 are arranged substantially complementary to each other, wherein the contact surfaces are configured in cross section as inclined planes.

A second illustrative embodiment of the lock cylinder 1 is shown in FIGS. 3*a* and 3*b*. The functionality of the lock cylinder is known from the prior art to the person skilled in the art and resembles the functionality described in the first illustrative embodiment. Unlike the first illustrative embodiment, the second illustrative embodiment shows that the cam portion 12 of a coupling element 7 forms a form closure with an opening 11 of the bearing 8, wherein in this illustrative embodiment the end of the cam portion 12 forms a form closure with the housing 2, in particular with an opening 14 arranged in the housing 2 (see FIG. 3*b*). In FIGS. 4*a* and 4*b*, a third embodiment of the lock cylinder 1 is represented, which lock cylinder is essentially a combination of the first and second illustrative embodiment. In addition to that form closure between bearing 8 and coupling element 7 which is shown in FIG. 3*b*, a form closure between the disengaging sleeve 6 and the housing 2, and the disengaging sleeve 6 with the bearing 8, is herein disclosed.

Within the scope of said illustrative embodiments, in particular with respect to the second and third illustrative embodiment, reference is made to DE 102009050905.4.

REFERENCE SYMBOL LIST

1 lock cylinder
2 housing
3 sleeve
4 cylinder core
5 tumblers
6 disengaging sleeve
7 coupling element
8 bearing
9 output element
10 pin
11 opening of the bearing
11.1 recess
12 cam portion
13 recess in the housing
14 opening in the housing

The invention claimed is:

1. A lock cylinder comprising
a housing;
a sleeve rotatably mounted in the housing;
a cylinder core accommodated in the sleeve, said cylinder core having spring-loaded tumblers;
a coupling element coupled to the sleeve within the housing by a disengaging sleeve, wherein the coupling element is mounted within the housing;
a bearing connected to the coupling element in a rotationally fixed manner, wherein the bearing serves to support an output element; and
a form closure formed with the bearing and resisting rotation of the output element about an axis if an improper object is used in operative connection with the cylinder core.

2. The lock cylinder as claimed in claim 1, in which the bearing has at least one recess or opening, which respectively forms the form closure with a cam portion.

3. The lock cylinder as claimed in claim 2, in which the housing has at least one of at least one opening and recess forming part of the form closure with the cam portion.

4. The lock cylinder as claimed in claim 3, in which the recess is a groove.

5. The lock cylinder as claimed in claim 2, in which a contact surface of the cam portion and a contact surface of the bearing are substantially complementary to each other.

6. The lock cylinder as claimed in claim 5, in which the contact surface of the cam portion and the contact surface of the bearing is respectively configured as an inclined plane.

7. The lock cylinder as claimed in claim 1, in which at least one of the disengaging sleeve and coupling element form part of the form closure with the housing.

8. The lock cylinder as claimed in claim 1, in which the disengaging sleeve forms part of the form closure.

9. The lock cylinder as claimed in claim 1, in which the coupling element forms part of the form closure.

10. The lock cylinder as claimed in claim 1, in which the output element is an espagnolette.

11. The lock cylinder as claimed in claim 1, in which the improper object is a tool used to forcibly decouple the lock cylinder from the bearing.

* * * * *